US007610842B1

(12) United States Patent
Brooks

(10) Patent No.: US 7,610,842 B1
(45) Date of Patent: Nov. 3, 2009

(54) WEAPON MOUNTING SYSTEM

(75) Inventor: Adam S. Brooks, Sellersburg, IN (US)

(73) Assignee: Kiesler Police Supply, Inc., Jeffersonville, IN (US)

( * ) Notice: Subject to any disclaimer, the term of this patent is extended or adjusted under 35 U.S.C. 154(b) by 0 days.

(21) Appl. No.: 11/677,085

(22) Filed: Feb. 21, 2007

(51) Int. Cl.
*F41A 23/00* (2006.01)

(52) U.S. Cl. ..... 89/37.03; 89/37.01; 89/37.07; 89/37.12; 89/40.01; 42/94

(58) Field of Classification Search ..... 42/94; 89/37.01, 37.03, 37.07, 37.13, 40.01, 40.03, 89/40.04, 37.02; 248/354.1, 354.5, 188.4
See application file for complete search history.

(56) References Cited

U.S. PATENT DOCUMENTS

| | | | | | |
|---|---|---|---|---|---|
| 2,228,179 | A * | 1/1941 | Motley | 89/37.03 |
| 2,475,089 | A * | 7/1949 | Green et. al. | 89/136 |
| 4,007,554 | A * | 2/1977 | Helmstadter | 42/94 |
| 4,937,965 | A * | 7/1990 | Narvaez | 42/94 |
| 5,194,678 | A * | 3/1993 | Kramer | 42/94 |
| 5,723,808 | A * | 3/1998 | Devall | 89/37.04 |
| 5,815,974 | A * | 10/1998 | Keng | 42/94 |
| 6,250,196 | B1 * | 6/2001 | Sanderson | 89/37.16 |
| 6,250,197 | B1 * | 6/2001 | Sanderson | 89/37.16 |
| 6,286,411 | B1 * | 9/2001 | Sanderson | 89/37.16 |
| 6,293,179 | B1 * | 9/2001 | Sanderson | 89/37.03 |
| 6,308,610 | B1 * | 10/2001 | Deichmann et al. | 89/40.01 |
| 6,675,694 | B1 * | 1/2004 | Liebig | 89/40.08 |
| 7,281,347 | B2 * | 10/2007 | Carpenter | 42/94 |
| 2004/0194241 | A1 * | 10/2004 | Hale | 15/104.33 |
| 2004/0237372 | A1 * | 12/2004 | Frye | 42/94 |
| 2007/0169391 | A1 * | 7/2007 | Carpenter | 42/94 |
| 2008/0092732 | A1 * | 4/2008 | Becker et al. | 89/37.03 |

* cited by examiner

*Primary Examiner*—Stephen M Johnson
*Assistant Examiner*—Daniel J Troy
(74) *Attorney, Agent, or Firm*—Alexander P. Brackett; Middleton Reutlinger

(57) ABSTRACT

A weapon mounting system for securing a weapon such as a machine gun to a platform comprises a base mount that is secured to the platform and that rotatably supports a pintle receiver tube. The pintle receiver tube is adjustable and rotatable such that a weapon may be readily aimed in multiple planes. The invention further includes a cradle that is easily secured to the pintle and thus to the platform.

18 Claims, 10 Drawing Sheets

WEAPON MOUNTING SYSTEM

BACKGROUND OF THE INVENTION

1. Field of the Invention

The present invention relates generally to a system for securing a weapon to a platform and more particularly to a weapon mounting system having a cradle that is readily secured to a machine gun or rifle having a pair of spaced attachment points and a base mount portion that permits the cradle to rotate around two spaced axes for rapid aiming of the weapon.

2. Description of the Related Art

Many weapons, particularly those suited for use in military operations, have a size and weight that prohibits them from being employed by a user because they cannot be accurately aimed or stabilized without being mounted to a platform of some type, for example the bed of a truck or jeep. Accordingly, mounting devices and other apparatus are often employed in an attempt to serve several objects that are often at cross-purposes: reliably secure the weapon to the platform, enable a shooter to quickly and accurately aim the weapon when needed, and enable the weapon to be readily removed for repair and cleaning.

A wide variety of mounting interfaces have been employed in the prior art solve these problems. For example, U.S. Pat. No. 6,675,694 to Liebig discloses a mounting apparatus specifically suited to a weapon that does not have a forward mount point such as an MK 46 machine gun. This mount secures to the weapon utilizing the ammunition can thereof as an attachment point, and supplies a main coupling that can be attached to an existing tripod or other vehicle mount.

U.S. Pat. No. 4,417,499 to Grosser et al. provides a mounting apparatus for a weapon that permits its azimuth and elevation to be adjustable by providing trunnion arms at an upper end that engage the weapon trunnions.

While many of these prior art systems provide various types of weapons mounts, they nearly all suffer from several drawbacks. Many prior art systems are manufactured from heavy materials that provides an additional load that the platform must carry. Additionally, a mounting system that weighs a great deal prohibits quick aiming of the weapon which can be an extreme disadvantage in a hostile environment.

Some mounting systems employ weapons attachment apparatus manufactured from aluminum or aluminum alloys that are subsequently bent or otherwise shaped into a suitable configuration for engaging a weapon. However, in many of these systems the mating points with the weapon are not consistently placed, thereby leading to some mounts that don't readily accept or positively secure the weapon on the mount. Furthermore, many prior art systems include a multiplicity of parts that require operator adjustment and that may be broken or misplaced.

Accordingly, there is a need for a lightweight weapons mount system that can quickly accept and positively secure a weapon to a platform, and that provides for rapid aiming of the weapon without the necessity of a great number of parts.

SUMMARY OF THE INVENTION

The present invention provides an apparatus and system for securing a weapon having a plurality of contact points to a platform for quick and easy use. The invention includes a cradle having front and rear inserts that engage a plurality of contact points of the weapon quickly and securely. The invention further comprises a base portion for supporting the cradle that permits the weapon to be easily rotated through 360 degrees, yet easily removed from the base for cleaning and repair.

The cradle includes a front insert and a rear insert, each of which are secured to the cradle with fasteners or the like. In one embodiment of the invention, the cradle and its concomitant front and rear inserts are machined from a single piece of high-strength material, for example stainless steel. This feature of the invention provides for a plurality of weapon contact points that remain consistent in their positions relative to the weapon components over time and under rugged conditions as encountered in the field.

The front insert includes a pair of opposed apertures that accept a retaining pin to secure a pintle thereto, as well as a pair of u-shaped tabs to engage a forward contact point of the weapon.

The rear insert includes a pair of generally upwardly extending tabs for engaging a rear contact point of the weapon as well as a spring biased keeper that permits a bottom contact point of the weapon to "click" into place and be held securely until the operator releases it by operation of a release lever.

The system and apparatus of the present invention further includes a base assembly that utilizes a cylindrical bearing assembly to provide for rotation in a horizontal plane, as well as a novel pivot head and pintle receiver for securing the rotatable base assembly to the pintle, and thus to the cradle and weapon.

Other objects, features and advantages of the instant invention will become apparent from the detailed description of the preferred embodiments included herein below, taken in conjunction with the drawing Figures

BRIEF DESCRIPTION OF THE DRAWING FIGURES

DETAILED DESCRIPTION OF THE PREFERRED EMBODIMENT(S)

Figure 1:
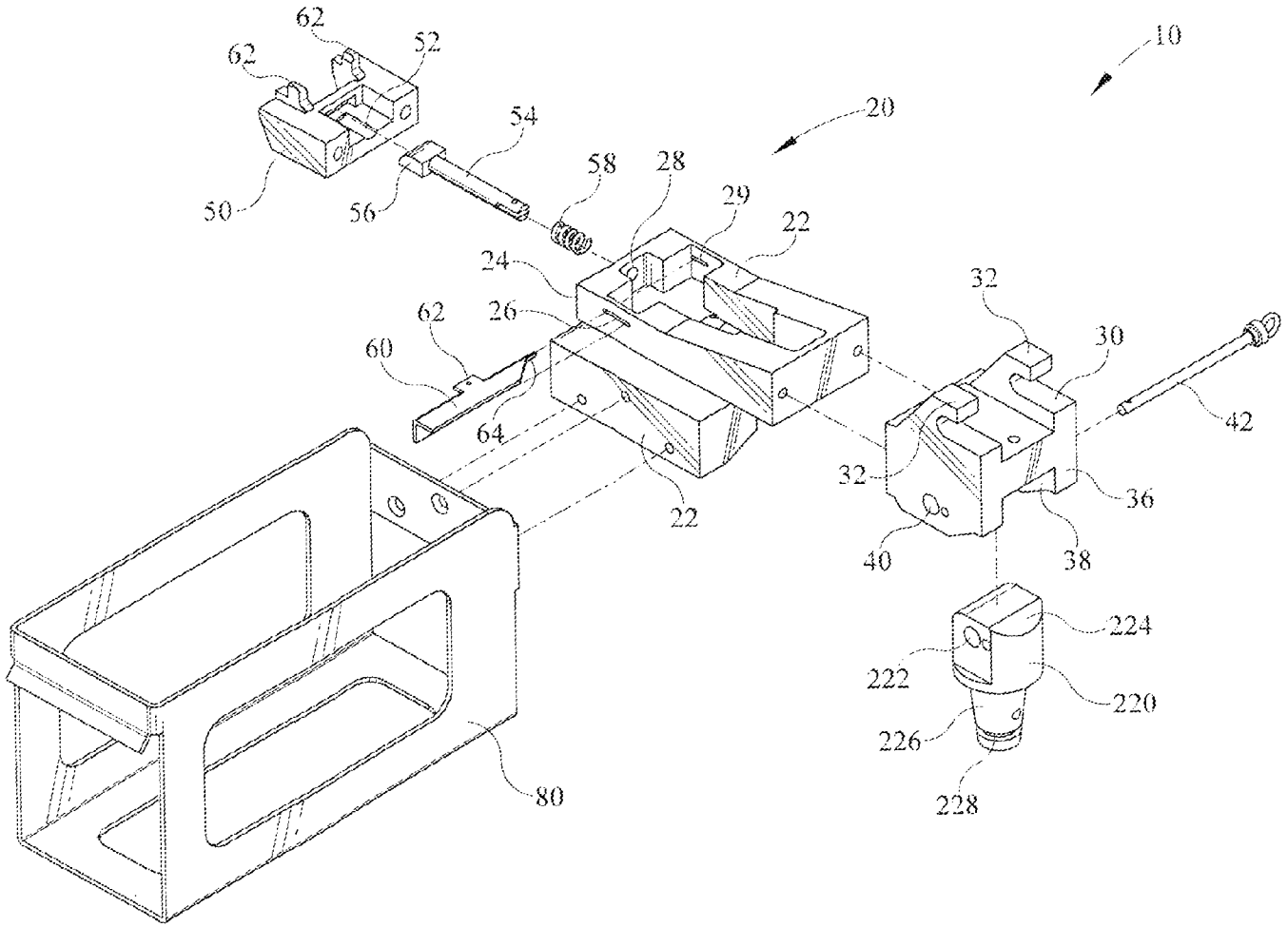
FIG. 1 is an exploded perspective view of a cradle assembly in accordance with one embodiment of the present invention.
Figure 1A:
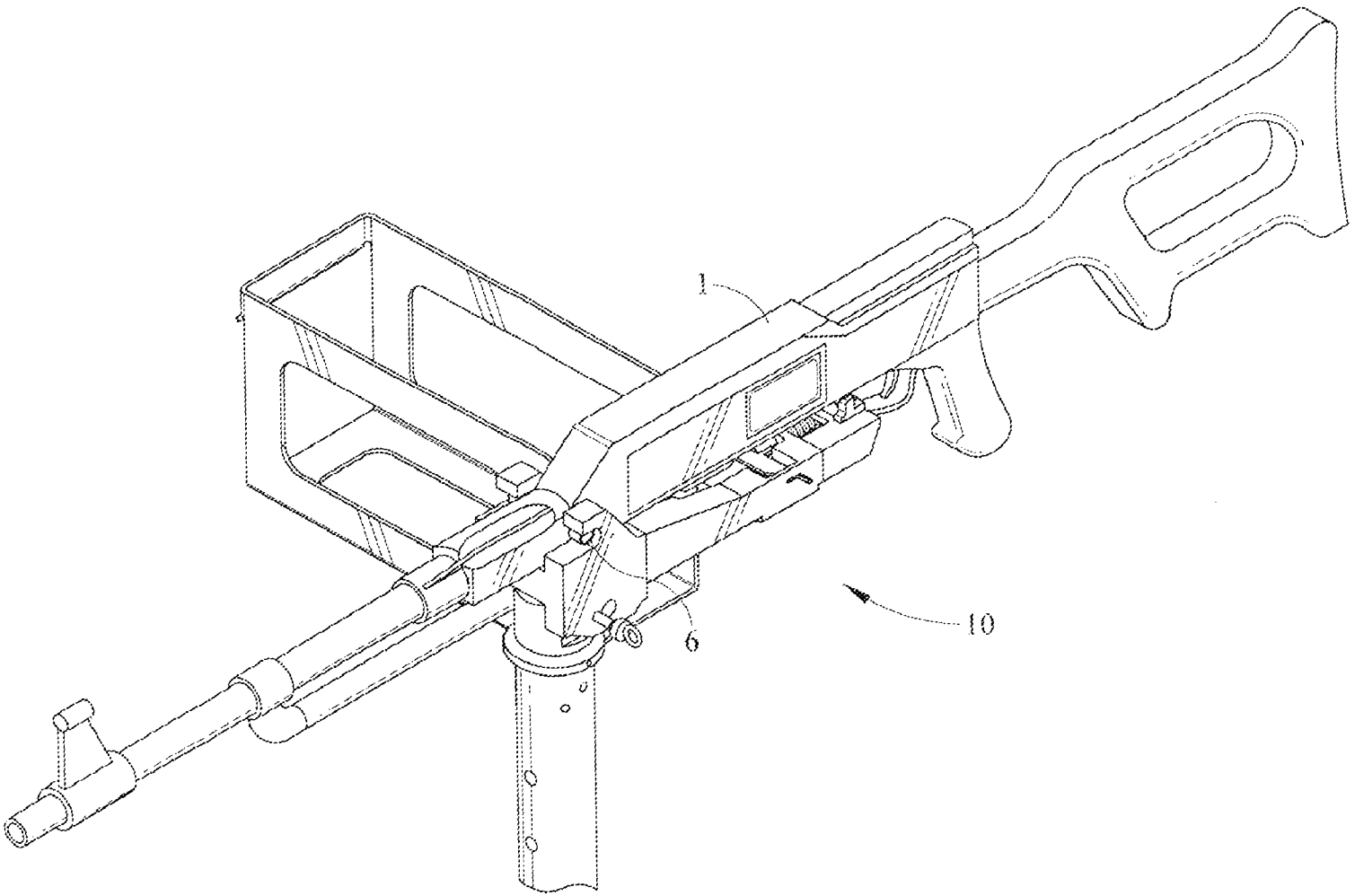
FIG. 1A is a perspective view of a cradle assembly with a weapon secured thereto.
Figure 1B:
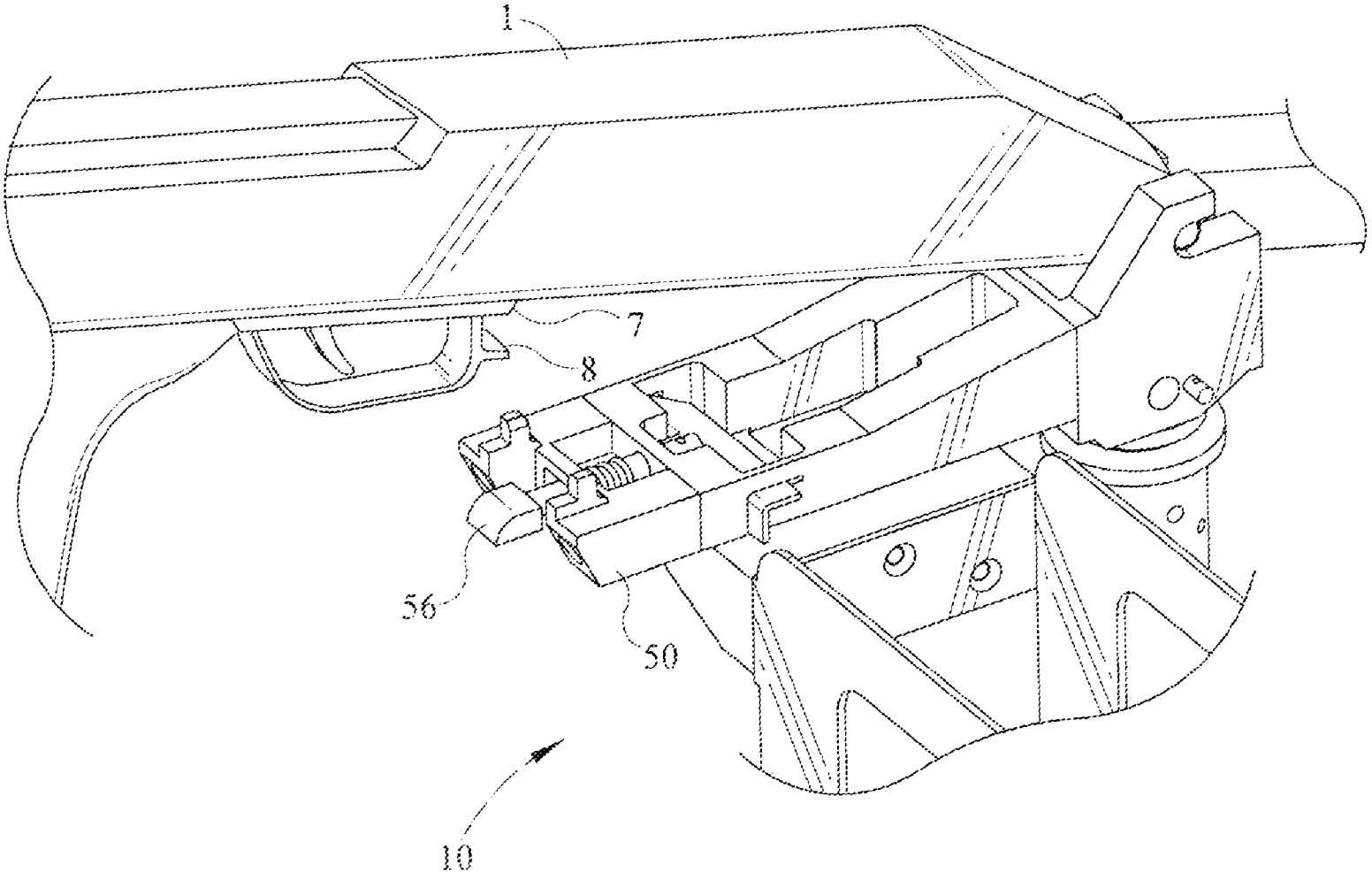
FIG. 1B is a perspective view of a cradle assembly with a weapon partially secured thereto.
Figure 2:
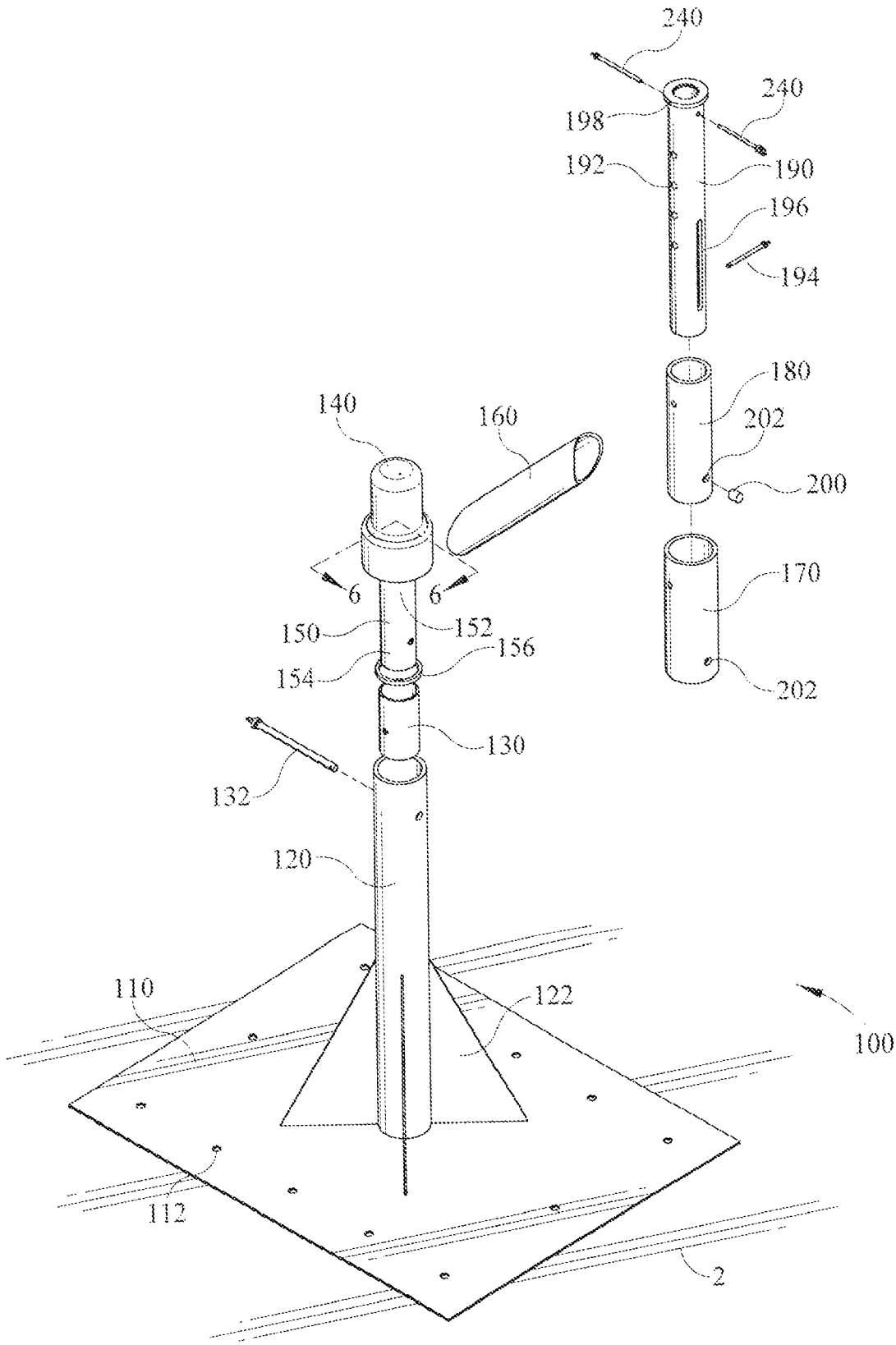
FIG. 2 is an exploded perspective view of a base assembly in accordance with one embodiment of the present invention.

Referring now to FIGS. 1, 1A and 2, and in accordance with a preferred constructed embodiment of the present invention, a weapons mounting system 10 for securing a weapon 1 such as a machine gun to a platform 2 includes a cradle 20. While the present system 10 may be adapted for use with a wide variety of weapons 1 the exemplary embodiments included herein refer primarily to a machine gun type weapon 1 having forward 6, bottom 7 and rear 8 contact points that are engaged by cradle 20 when weapon 1 is properly secured thereto.

Cradle 20 includes a center body 22 and a front insert 30 secured thereto by a conventional fastener or fasteners. Front insert 30, best seen in FIG. 3 includes a pair of spaced u-shaped tabs 32 that engage forward contact points 6 of weapon 1, as best seen in FIG. 1. Forward contact points 6 may be, for example, a pin or a spaced pair of pins arranged transversely to a longitudinal axis of weapon 1 such that the pin or pins engage spaced u-shaped tabs 32 as weapon 1 is secured in cradle 20.

Figure 3:
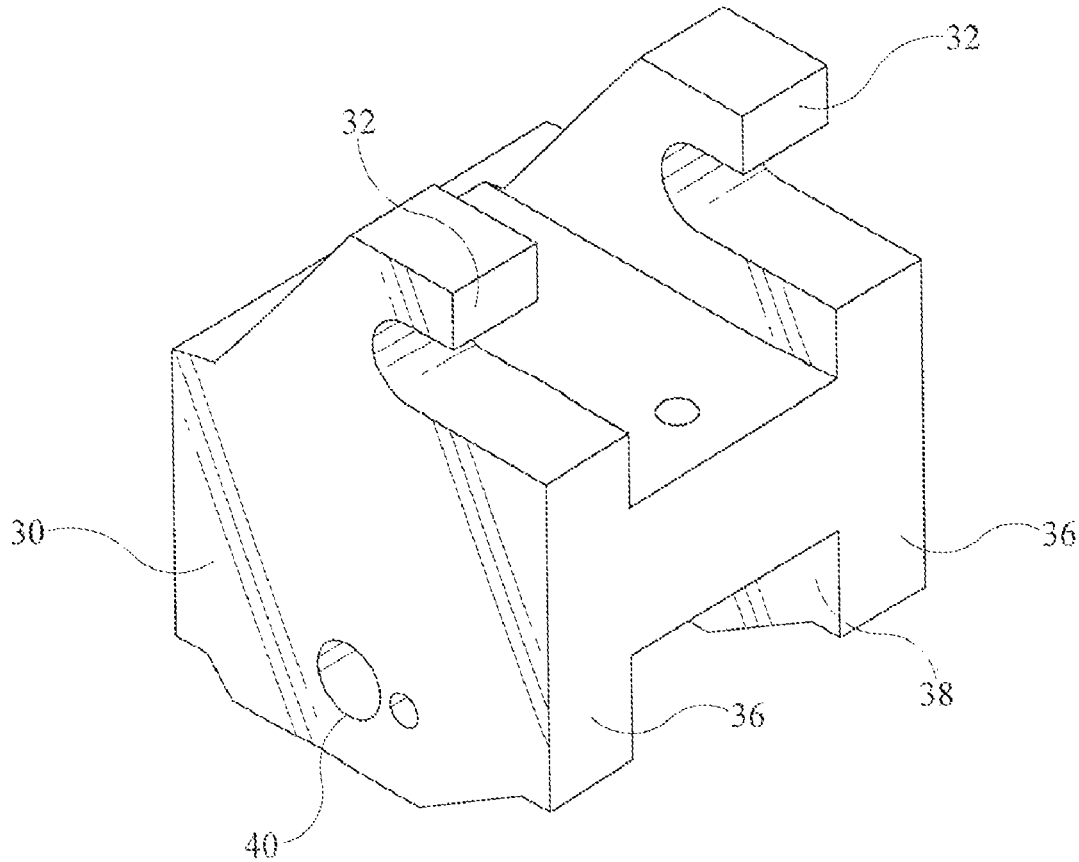
FIG. 3 is a perspective view of a front insert in accordance with one embodiment of the present invention.

As best seen in FIGS. 1 and 3, front insert 30 further comprises a pair of opposed lower walls 36 that define a pintle slot 38 on a bottom portion of front insert 30 that is shaped to accept the head of a pintle, as described in greater detail herein below. An aperture 40 through both lower walls 36 accepts a ball retaining pin 42. Both center body 22 and front insert 30 may be manufactured from a stainless steel alloy to enable precise location of weapon 1 within cradle 20. The entire cradle 20 assembly may rotate upwardly or downwardly around the axis defined by retaining pin 42, as discussed further herein below.

Figure 4:
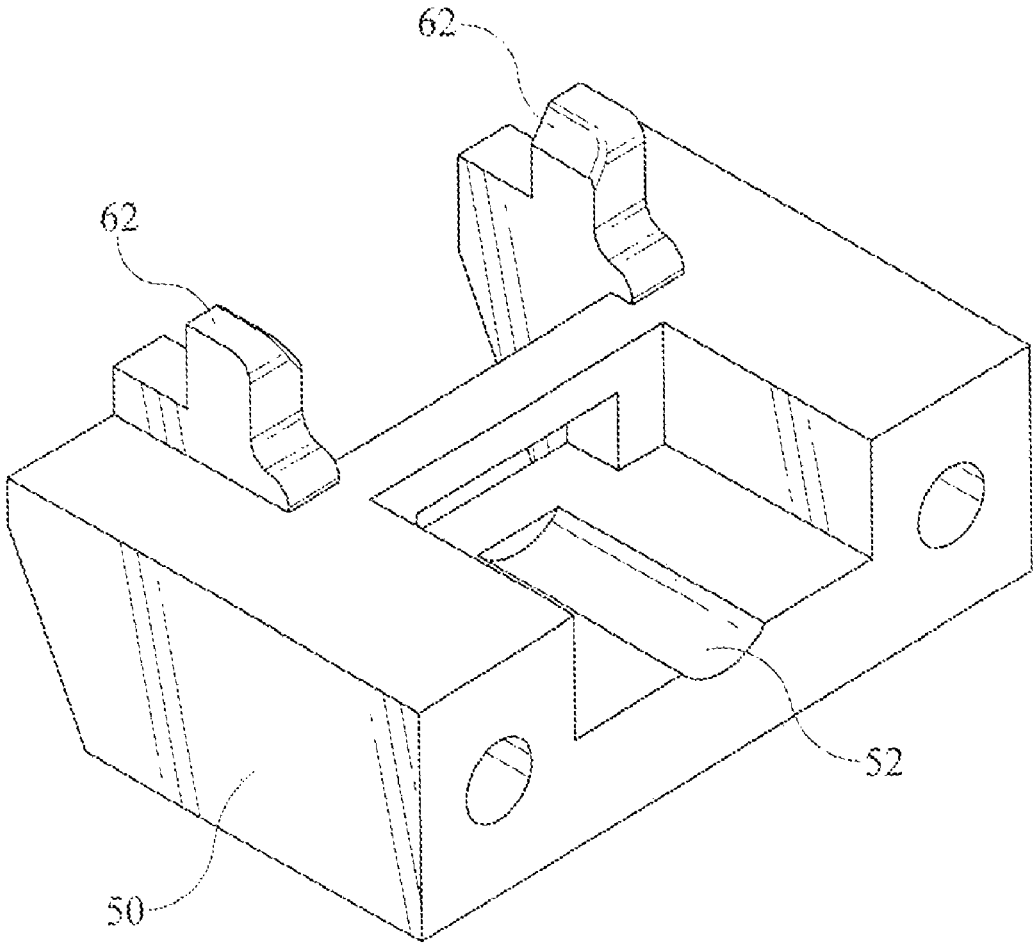
FIG. 4 is a perspective view of a rear insert in accordance with one embodiment of the present invention.

Cradle 20 further comprises a rear insert 50, shown in FIGS. 1 and 4. Rear insert 50 comprises a keeper pin 54 having a tongue 56 at a rear end thereof for engaging a contact point 8 of weapon 1, a keeper spring 58 for biasing keeper pin 54 to the engaged position, and a release lever 60 that disengages keeper tongue 56 from bottom contact point 8. Keeper pin 54 is disposed in a central longitudinal slot 52 of rear insert 50 and is biased into slot 52 by keeper spring 58.

Rear insert 50 further comprises a spaced pair of rear tabs 62 disposed at a rear portion of insert 50 and extending generally upwardly therefrom to engage contact point 7 of weapon 1. Rear insert 50 is secured to a rear face 24 of center body 22 by means of a conventional fastener or fasteners.

Center body 22 further includes a keeper pin aperture 28 through which an end of keeper pin 54 is positioned, and a release lever slot 26 on one side thereof through which release lever 60 is disposed. Release lever 60 is secured with a fastener to keeper pin 54 at a central point 62 on lever 60 such that an end 64 of release lever 60 engages an opposed slot 29 of center body 22. Thus spring 58 biases keeper pin 54 and tongue 56 rearwardly into slot 52 to engage a bottom contact point 8 of weapon 1, while release lever 60 may be pushed forward to disengage tongue 56. This feature of the invention enables a weapon to be quickly and securely affixed to mounting system 10 by simply slipping the forward contact point 6 into tabs 32 then pushing the rear of weapon 1 downwardly to "click" contact portion 8 into engagement with tongue 56.

Cradle 20 may further comprise an ammunition can holder 80 secured to a side thereof for ready access to ammunition while operating weapon 1. Can holder 80 is secured to cradle 20 utilizing conventional fasteners, or alternatively, may be provided as an integrally machined component thereto.

Figure 5:
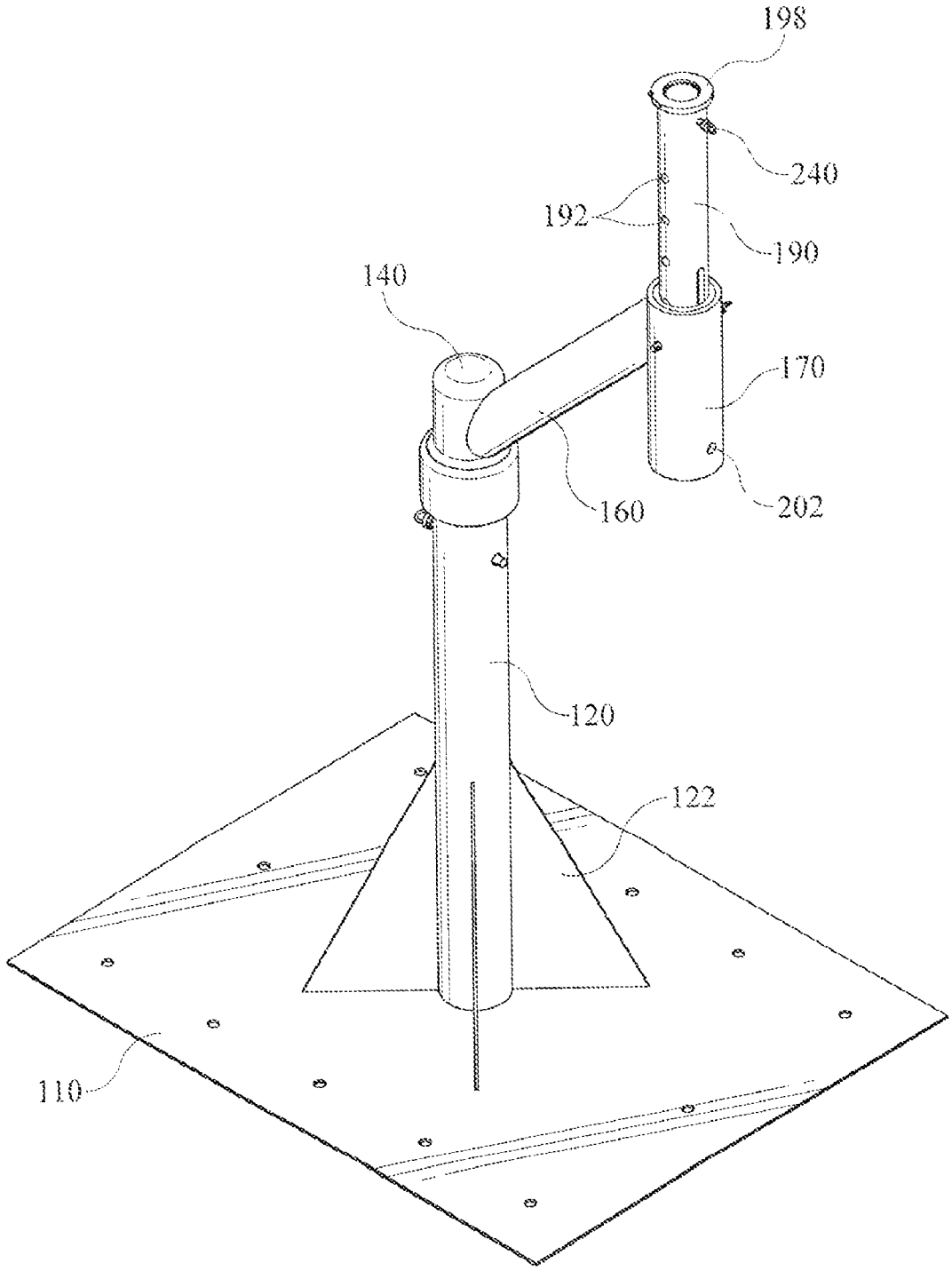
FIG. 5 is a perspective view of a base assembly in accordance with one embodiment of the present invention.

Referring now to FIGS. 2 and 5, and in accordance with an embodiment of the present invention, a base assembly 100 for securing cradle 20 to a vehicle or other supporting platform 2 may include a base plate 110 having a plurality of apertures 112 therethrough capable of accepting a plurality of fasteners for securing base plate to platform 6. Base assembly 100 further comprises a generally cylindrical base tube 120 secured to and depending upwardly from base support 110. A plurality of support gussets 122 may be secured to the outer walls of base tube 120 and also to base plate 110 to provide a very stable base tube 120 which supports the remaining components of base assembly 100.

A cylindrical bearing assembly 130 is disposed inside of base tube 120 to permit rotation of a pivot head 140 that is connected to bearing assembly 130 via a base arm insert 150, which is also generally cylindrical in shape and manufactured from, for example, stainless steel. In one embodiment of the present invention cylindrical bearing assembly 130 may comprise an oil-impregnated bronze bearing capable of bearing sufficient weight to support the weapon being secured to cradle 20. A variety of self-lubricating cylindrical bearings may be employed as bearing assembly 130 without departing from the scope of the invention. This feature of the present invention provides for a very robust base arm pivot head that enables easy rotation and aiming of weapon 1, despite its weight and size. Additionally, a retainer pin 132 may be employed to secure bearing assembly 130 into base tube 120 by inserting retainer pin 132 through corresponding apertures in base tube 120 and bearing assembly 130.

Figure 6:
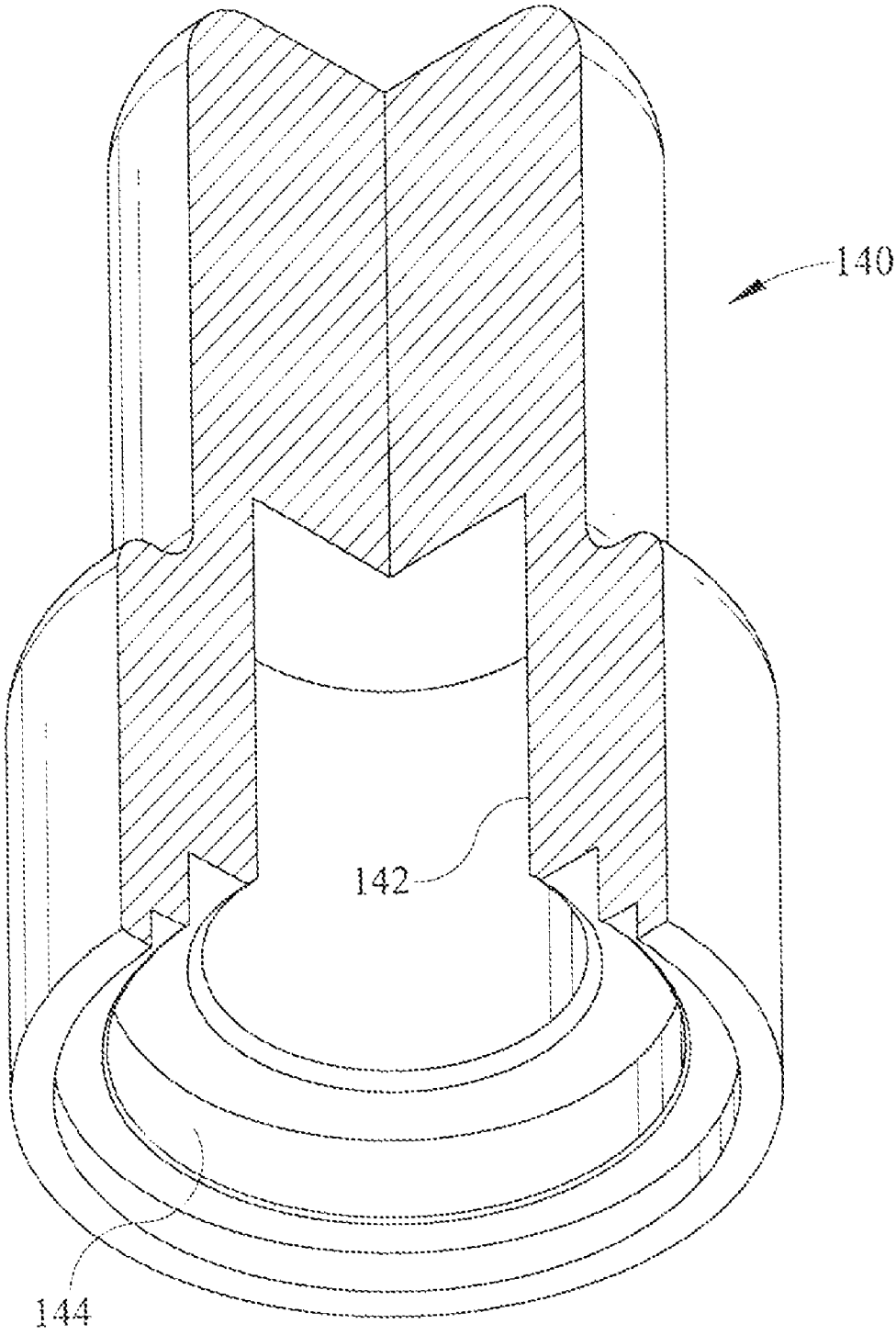
FIG. 6 is a view of a pivot head taken along the line 6-6 in accordance with one embodiment of the present invention.

Base arm insert 150 has an upper end 152 which engages a recessed portion 142 of pivot head 140, as best seen in FIG. 6. A lower end 154 of base arm insert 150 slides into bearing assembly 130 to permit rotation of base arm insert 150, and thus pivot head 140. Additionally, an annular stainless steel wear insert 156 is disposed at upper end 152 of base arm insert 150 to engage an annular race 144 within pivot head 140, as best seen in FIGS. 2 and 6. Wear insert 156 acts to align the axes of the base arm insert 150 and the pivot head 140 to prevent excessive wear during rotation.

As best seen in FIGS. 2 and 5, base assembly 100 further includes a support arm 160 that extends outwardly and upwardly from pivot head 140 and terminates in an end tube 170. End tube 170 is generally cylindrical in shape and accepts a cylindrical end tube sleeve 180 therein. End tube sleeve 180 is slightly smaller in diameter than end tube 170 to assure a snug fit between these two components.

Figure 7:
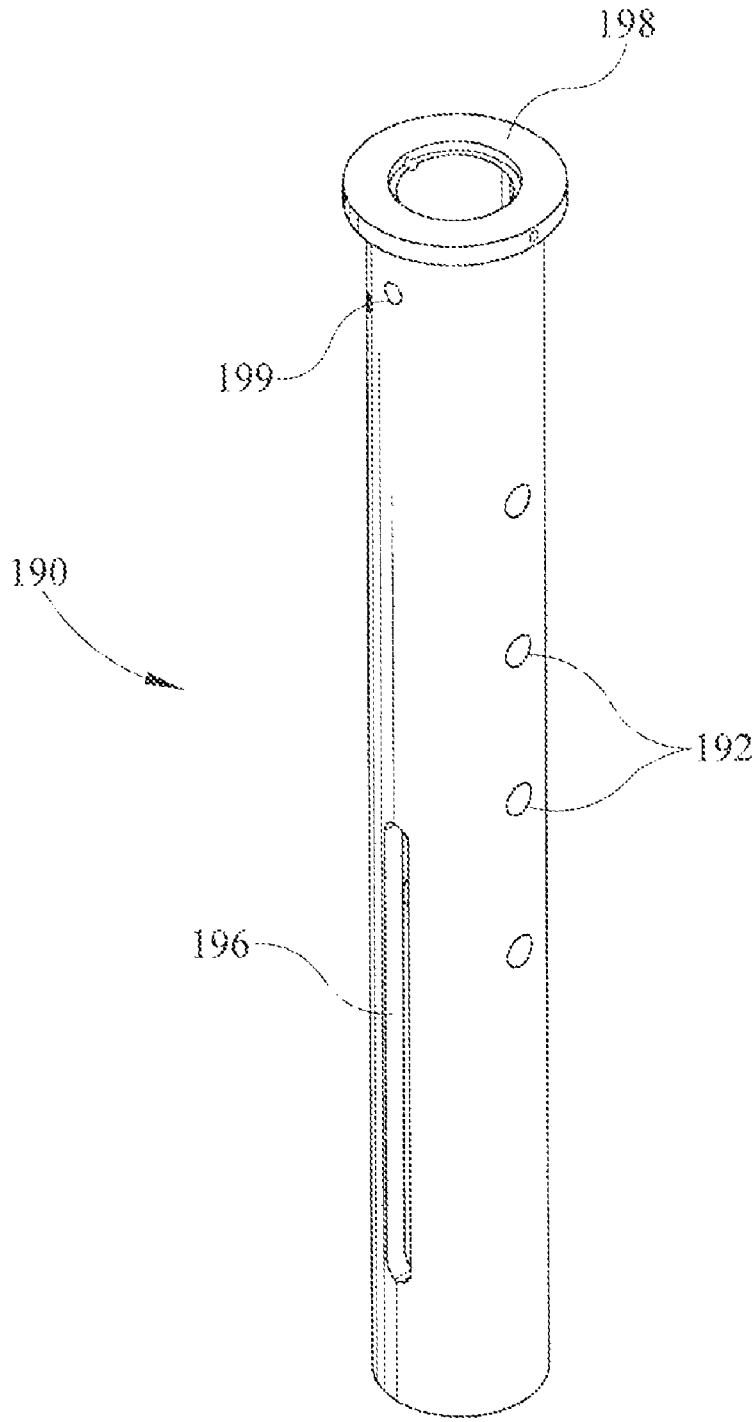
FIG. 7 is a perspective view of a pintle receiver tube in accordance with one embodiment of the present invention.

A pintle receiver tube 190, also generally cylindrical in shape, is sized to be received within end tube sleeve 180 and includes a plurality of spaced apertures 192 along its length such that the pintle receiver tube 190 may be adjusted upwardly or downwardly in end tube sleeve 180 by insertion of a retaining pin 194 through concentric apertures in end tube 170, end tube sleeve 180, and pintle receiver tube 190. As seen in FIGS. 2 and 7 pintle receiver tube 190 further comprises a longitudinal slot 196 along a portion thereof that is engaged by an alignment pin 200 that is inserted through a pair of concentric apertures 202 in end tube 170 and end tube sleeve 180 respectively. Alignment pin 200 permits pintle receiver tube 190 to travel upwardly or downwardly in end tube sleeve 180 while prohibiting it from being completely removed therefrom, since alignment pin 200 contacts a lower portion of slot 196 to limit its travel.

Figure 8:
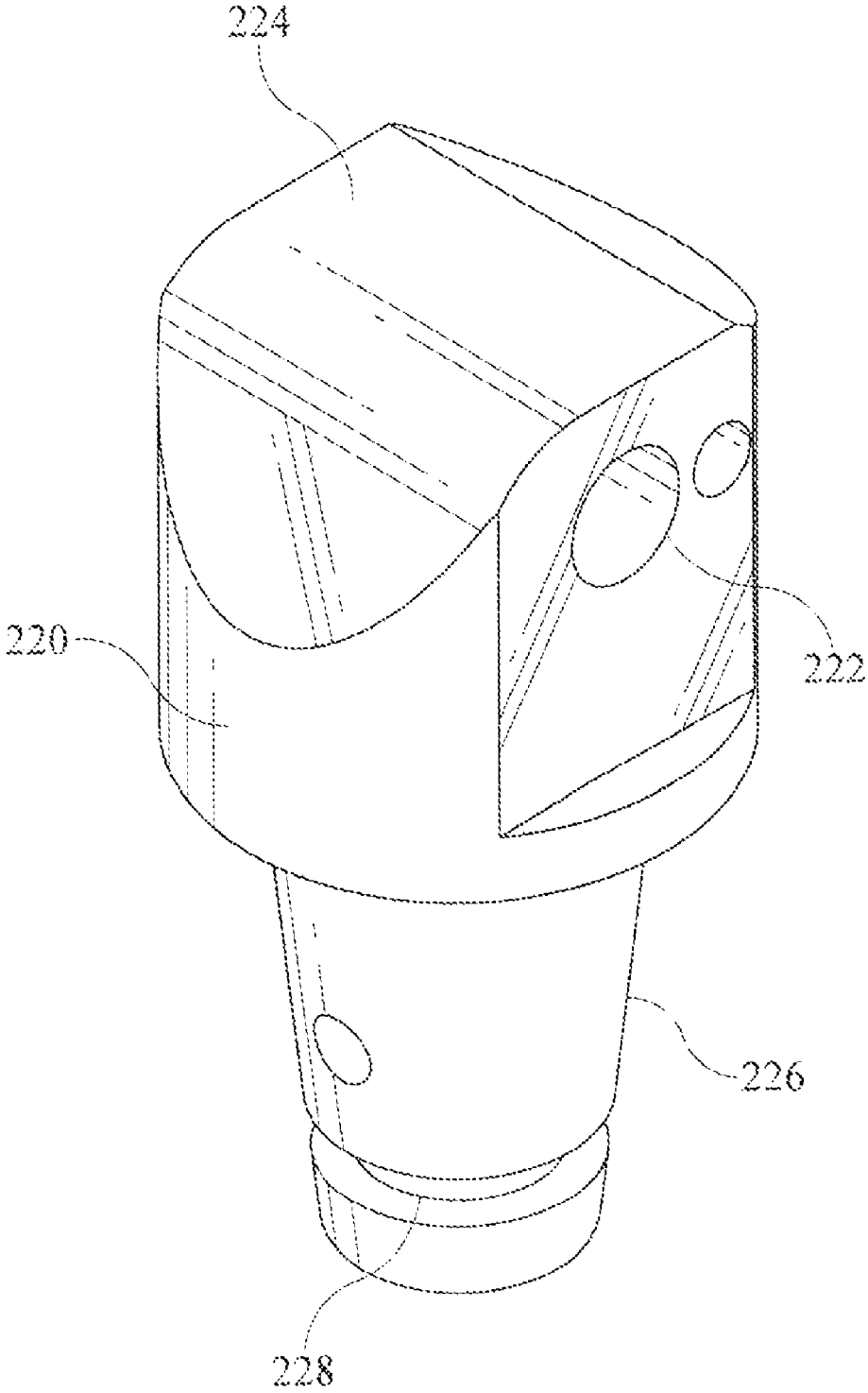
FIG. 8 is a perspective view of a pintle in accordance with one embodiment of the present invention.

The present invention further comprises a pintle 220, best seen in FIGS. 1 and 8 that includes a central aperture 222 therethrough that is aligned with apertures 40 of front insert 30 and secured thereto with a retaining pin through the aligned apertures. Pintle 200 further includes a head 224 on which front insert 30 rests which is shaped to provide for rotation of front insert 30 around the axis of the pintle aperture 222. This feature of the invention permits the weapon to be aimed in a vertical plane, while the base assembly 100 permits aiming of the weapon in the horizontal plane.

Pintle 220 further comprises a shank 226 that fits into a top portion 198 of pintle receiver 190 to complete the assembly of system 10. Pintle shank 226 includes an annular recess 228 at a bottom end thereof that is engaged by a plurality of ball release pins 240 as shank 226 is pushed into top portion 198 of receiver 190. Ball release pins 240 may be spring-biased into a plurality of apertures 199 at an upper end of receiver 190 such that pintle shank 226 forces the pins outwardly as it is inserted into receiver 190, whereupon pins 240 engage annular recess 228 of shank 226 to secure pintle 220, and thus cradle 20 to base assembly 100. This feature of the present invention further permits another axis of rotation, since pintle shank 226 is free to rotate inside of receiver tube 190.

In a yet further embodiment of the present invention, pintle receiver tube 190 is formed of a stainless steel alloy to provide for positive retention of pintle 220 and a high degree of wear resistance. Furthermore, cradle 20 and front and rear inserts 30 and 50 may also be machined of a stainless steel alloy to provide an assembly whose contact points with weapon 1 are identical from system to system. This feature of the invention permits a user to be assured that a weapon will always positively lock into place in system 10, despite its age or wear and tear.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A weapon mounting system for securing a weapon to a platform comprising:
- a base mount having a base tube;
- a pivot support assembly secured thereto rotatable about a central axis of said base tube, said pivot support assembly comprising;
  - a bearing assembly disposed inside said base tube, a base arm insert disposed inside said bearing assembly, and a pivot head having a recessed portion therein that accepts an upper end of said base arm insert, wherein said insert and said pivot head are rotatable about a generally vertical axis for positioning said weapon;
- a pintle receiver tube secured to said pivot support assembly for engaging a weapon;
- an annular race at an interior portion of said pivot head; and
- a bearing wear insert disposed at an upper end of said base arm insert for engaging the annular race of said pivot head and providing for rotation thereof.

2. A weapon mounting system for securing a weapon to a platform as claimed in claim 1 wherein said pivot support assembly comprises:
- an end tube;
- a support arm secured to and extending from a pivot head at a first end thereof, and secured to said end tube at a second end thereof; and
- an end tube sleeve disposed within said end tube.

3. A weapon mounting system for securing a weapon to a platform as claimed in claim 2 wherein said pintle receiver tube is disposed within said end tube sleeve and wherein said pintle receiver tube comprises an open end for receiving a pintle therein to secure a weapon to said mounting system.

4. A weapon mounting system for securing a weapon to a platform as claimed in claim 3 wherein said pintle receiver tube comprises a plurality of apertures along its length for accepting a retaining pin therein; and
- wherein said end tube and said end tube sleeve each have concentric apertures for receiving said retaining pin therethrough.

5. A weapon mounting system for securing a weapon to a platform as claimed in claim 2 wherein said end tube sleeve and said pintle receiver tube comprise a stainless steel alloy.

6. A weapon mounting system as claimed in claim 2 wherein said pintle receiver tube further comprises:
- a longitudinal slot disposed along said pintle receiver tube, said longitudinal slot engaging a pin for limiting the vertical position of said pintle receiver tube relative to said pivot support assembly.

7. A weapon mounting system as claimed in claim 6 further comprising:
- a pair of concentric apertures in a lower portion of said end tube and said end tube sleeve for accepting an alignment pin that extends therethrough to engage the longitudinal slot of said pintle receiver tube.

8. A weapon mounting system for securing a weapon to a platform as claimed in claim 1 wherein said pivot support assembly comprises:
- an end tube;
- a support arm secured to and extending from said pivot head at a first end thereof, and secured to said end tube at a second end thereof; and
- an end tube sleeve disposed within said end tube.

9. A weapon mounting system for securing a weapon to a platform as claimed in claim 8 wherein said pintle receiver tube is disposed within said end tube sleeve and wherein said pintle receiver tube comprises an open end for receiving a pintle therein to secure a weapon to said mounting system.

10. A weapon mounting system for securing a weapon to a platform as claimed in claim 9 wherein said pintle receiver tube comprises a plurality of apertures along its length for accepting a retaining pin therein; and
- wherein said end tube and said end tube sleeve each have concentric apertures for receiving said retaining pin therethrough.

11. A weapon mounting system for securing a weapon to a platform as claimed in claim 1 wherein said bearing assembly is an oil impregnated bronze cylindrical bearing.

12. A weapon mounting system as claimed in claim 1 further comprising
- a base plate secured to said base tube at a lower portion thereof for securing said system to a platform.

13. A weapon mounting system as claimed in claim 12 further comprising:
- a plurality of gussets secured between said base plate and said base tube to provide rigidity and support to said base tube.

14. A weapon mounting system as claimed in claim 1 further comprising
- a base plate secured to said base tube at a lower portion thereof for securing said system to a platform.

15. A weapon mounting system as claimed in claim 1 wherein said pintle receiver tube further comprises:
- a longitudinal slot disposed along a portion of said pintle receiver tube, said longitudinal slot engaging a pin for limiting the vertical position of said pintle receiver tube relative to said pivot support assembly.

16. A weapon mounting system for securing a weapon to a platform comprising:
- a base tube for securing said mounting system to a platform;
- a pivot support assembly having a bearing assembly disposed inside said base tube, a base arm insert disposed inside said bearing assembly, and a pivot head having a recessed portion therein that accepts an upper end of said base arm insert, wherein said insert and said pivot head are rotatable about a generally vertical axis for positioning said weapon;
- a support arm having a first end secured to said pivot support assembly and having a second end;

an end tube secured to said support arm second end such that said support arm, said end tube, and said pivot assembly are rotatable about a central axis of said base tube;

an annular race at an interior portion of said pivot head;

a bearing wear insert disposed at an upper end of said base arm insert for engaging the annular race of said pivot head and providing for rotation thereof;

a pintle receiver tube having a plurality of apertures therein, said receiver tube inserted inside said end tube; and at least one aperture in said end tube capable of accepting a retaining pin for engaging the apertures of said pintle receiver tube whereby the vertical position of said receiver tube may be adjusted with respect to said end tube.

17. A weapon mounting system for securing a weapon to a platform as claimed in claim 16 further comprising:

a longitudinal slot disposed along a length of said pintle receiver tube for engaging a pin extending inwardly from said end tube, whereby said pin limits the vertical travel of said pintle receiver tube.

18. A weapon mounting system for securing a weapon to a platform as claimed in claim 16 further comprising:

an end tube sleeve disposed inside said end tube; and wherein said pintle receiver tube is disposed within said end tube sleeve and wherein said pintle receiver tube comprises an open end for receiving a pintle therein to secure a weapon to said mounting system.

* * * * *

UNITED STATES PATENT AND TRADEMARK OFFICE

CERTIFICATE OF CORRECTION

PATENT NO. : 7,610,842 B1
APPLICATION NO. : 11/677085
DATED : November 3, 2009
INVENTOR(S) : Adam S. Brooks It is certified that error appears in the above-identified patent and that said Letters Patent is hereby corrected as shown below:

Column 3, line 8, insert -- A -- after "FIG 1";
Column 3, line 61, delete "6" and insert -- 2 --; and,
Column 4, line 55, delete "200" and insert -- 220 --.

Signed and Sealed this

Second Day of November, 2010

David J. Kappos

David J. Kappos
*Director of the United States Patent and Trademark Office*